United States Patent [19]

Abbassi

[11] Patent Number: 4,670,931

[45] Date of Patent: Jun. 9, 1987

[54] TOOTHBRUSH

[76] Inventor: Maliheh Abbassi, 7136 Fallbrook Ave., Canoga Park, Calif. 91307

[21] Appl. No.: 826,947

[22] Filed: Feb. 7, 1986

[51] Int. Cl.[4] ..... A46B 9/04

[52] U.S. Cl. ..... 15/167 R; D4/105; 15/106

[58] Field of Search ..... 15/167 R, 106, 172, 15/176; D4/104–112

[56] References Cited

U.S. PATENT DOCUMENTS

| | | | |
|---|---|---|---|
| 335,345 | 2/1886 | Estabrook | 15/167 R |
| 2,274,042 | 2/1942 | Cosby | 15/167 R |
| 2,736,917 | 3/1956 | Goldstein et al. | 15/167 R X |
| 2,819,482 | 1/1958 | Applegate | 15/110 |
| 3,754,295 | 8/1973 | Hyman | 15/167 R |
| 3,934,298 | 1/1976 | Kim | 15/167 R |
| 4,185,349 | 1/1980 | Papas | 15/106 |
| 4,399,582 | 8/1983 | Ernest et al. | 15/167 R X |

FOREIGN PATENT DOCUMENTS

| | | | |
|---|---|---|---|
| 236488 | 7/1925 | United Kingdom | 15/167 R |

*Primary Examiner*—Peter Feldman
*Attorney, Agent, or Firm*—Henderson & Sturm

[57] ABSTRACT

A toothbrush including a tip portion that is off-set from and narrower than a straight handle portion. The straight handle portion carries a rubber tip stimulator at one end, serrated non-slip surface near the middle, and a major brush portion at the other end. The off-set end portion extends up from the handle portion at the major brush portion end and carries a second smaller brush which is conveniently positioned at the tip to provide maximum access to the rear molars and wisdom teeth.

1 Claim, 6 Drawing Figures

TOOTHBRUSH

TECHNICAL FIELD

This invention relates to toothbrushes and more particularly to a toothbrush which provides for better dental hygiene in the rear portion of the mouth in the area of the rear molars and wisdom teeth.

BACKGROUND ART

The art associated with toothbrushes is a crowded one indicating that the search for the ideal solution to ultimate dental hygiene has been a long one. Attempts have been made in specially designing the bristle composition, direction and configuration; specially designing two separate bristle portions at opposite ends of the handle; and specially designing numerous features useful in promoting good dental hygiene.

Conventional toothbrushes are limited in their effectiveness in cleaning areas at the rear of the mouth due to the relatively large width of the base where the end bristles are located. Also, the base of a conventional toothbrush is typically flat where the bristles are located thereby further limiting access to the rear molars and wisdom teeth.

Those concerned with these and other problems recognize the need for an improved toothbrush.

DISCLOSURE OF THE INVENTION

The present invention provides a toothbrush including a tip portion that is off-set from and narrower than a straight handle portion. The straight handle portion carries a rubber tip stimulator at one end, serrated non-slip surface near the middle, and a major brush portion at the other end. The off-set end portion extends up from the handle portion at the major brush portion end and carries a second smaller brush which is conveniently positioned at the tip to provide maximum access to the rear molars and wisdom teeth.

The toothbrush provides for the ultimate in dental hygiene since it is specifically designed to reach and clean those hard to reach areas at the rear of the mouth. This ultimate dental hygiene toothbrush may also be conveniently used by people with relatively small mouths, and it could be used to clean dentures as well.

An object of the present invention is the provision of an improved toothbrush.

Another object is to provide a toothbrush that is adapted to reach and clean the area at the rear of the mouth.

A further object of the invention is the provision of a toothbrush that is convenient to use.

Still another object is to provide a toothbrush that is simple in design.

A still further object of the present invention is the provision of a toothbrush that is inexpensive to manufacture while being effective in providing the ultimate in dental hygiene.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
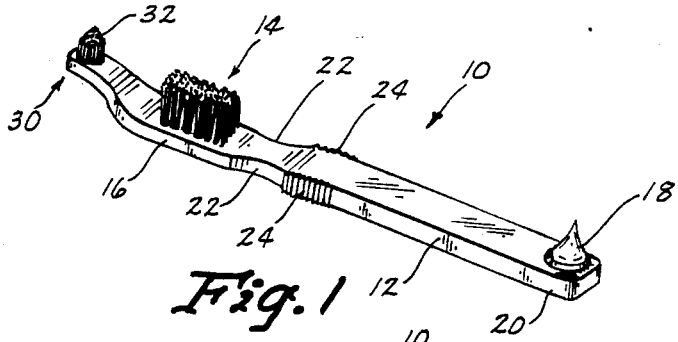
FIG. 1 is a perspective view showing the toothbrush of the present invention including a small brush portion carried on a narrowed and upwardly off-set tip.
Figure 2:
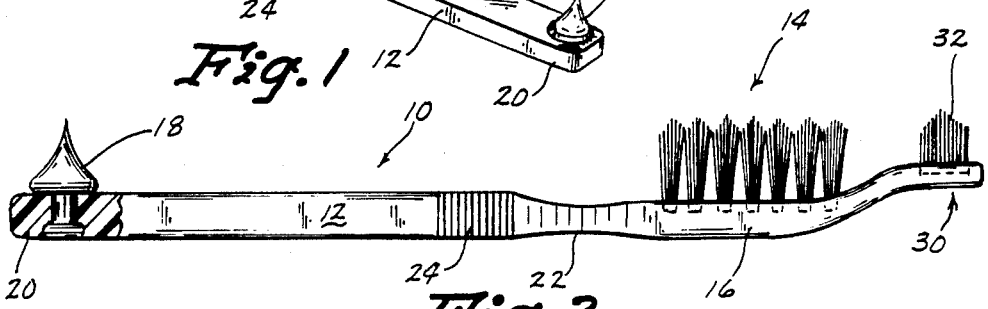
FIG. 2 is an enlarged side elevational view of the toothbrush having portions cut away to illustrate the mounting of a rubber tip stimulator.
Figure 3:
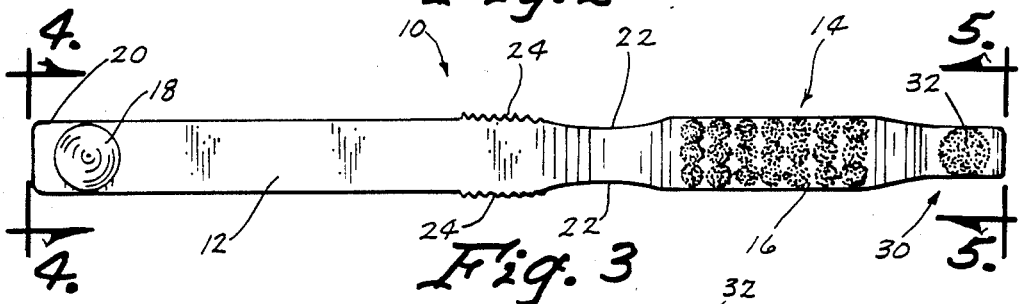
FIG. 3 is a top plan view of the toothbrush.
Figure 4:
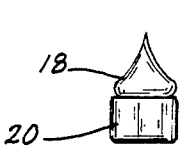
FIG. 4 is a rear elevational view taken along line 4—4 of FIG. 3.
Figure 5:
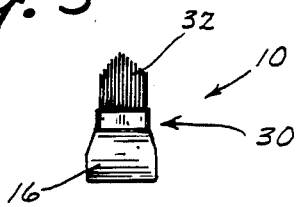
FIG. 5 is a front elevational view taken along line 5—5 of FIG. 3.
Figure 6:
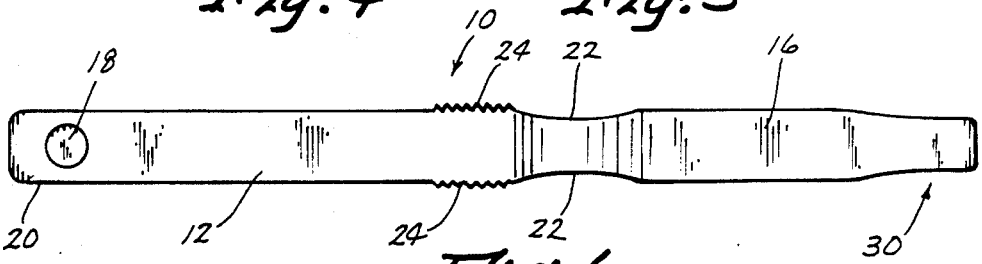
FIG. 6 is a bottom plan view thereof.

Referring now to the drawings, wherein like reference numerals designate identical or corresponding parts throughout the several views, FIG. 1 shows the toothbrush (10) of the present invention. The toothbrush (10) includes a handle (12) which carries a first major brush portion (14) at one end (16), and a rubber tip stimulator (18) at the other end (20). The handle (12) also includes a recessed grip section (22) and a serrated, non-slip surface (24) disposed intermediate the ends (16 and 20). As best shown in FIGS. 3 and 6, the serrated surface (24) extends down opposite lateral sides of the handle (12) to minimize slippage of the fingers as the toothbrush (10) is used. FIG. 2 shows that the major brush portion (14) includes a zig-zag surface pattern for more in-depth cleaning of the surface part of the tooth area.

Referring now to FIGS. 1 and 2, it can be seen that the tip portion (30) extends outwardly and upwardly from one end (16) of the handle (12). FIGS. 1, 3 and 6 clearly show that the width of the tip (30) is narrower than the width of the handle (12).

A second smaller brush portion (32) is carried on the tip portions (30). The second brush portion (32) extends perpendicularly outward from the tip portion (30) beyond the first brush portion (14), as best shown in FIG. 2.

The narrow width of the tip portion (30) and the outward extension of the second brush portion (32) provide access to the rear molars and wisdom teeth so that these difficult to reach areas can be properly and conveniently cleaned. This greatly improved access provides for the ultimate in dental hygiene.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. In a toothbrush including a generally straight, flat handle having a first major brush portion disposed to extend perpindicularly therefrom at one end thereof, said handle having a substantially uniform width from one end to the other end thereof, the improvement consisting of:

a tip portion attached to and extending substantially outwardly and upwardly beyond and at a substantial distance spaced from said one end of said handle carrying said major brush portion, said tip portion having a narrower width than said handle, and a second smaller brush portion attached to said tip portion and disposed to extend perpendicularly therefrom, said second brush portion being disposed to extend upwardly beyond and at a substantial distance spaced from said first brush portion, wherein the first major brush portion and the second smaller brush portion are disposed parallel to one another, whereby the spacing between the major brush portion and the smaller brush portion will bridge a users teeth.

* * * * *